United States Patent [19]

Swanson

[11] Patent Number: 4,902,054

[45] Date of Patent: Feb. 20, 1990

[54] SAFETY DEVICE FOR DISABLING A SCREEN DOOR LATCHING MECHANISM

[76] Inventor: David A. Swanson, 1217 W. Fourth St., Tempe, Ariz. 85281

[21] Appl. No.: 325,369

[22] Filed: Mar. 20, 1989

[51] Int. Cl.[4] ..... E05B 15/00

[52] U.S. Cl. ..... 292/254; 292/150; 292/DIG. 21

[58] Field of Search ..... 292/150, 254, 341.15, 292/152, 137, 145, D21

[56] References Cited

U.S. PATENT DOCUMENTS

| | | | |
|---|---|---|---|
| 1,351,117 | 8/1920 | Newhall | 292/341.15 |
| 1,364,757 | 1/1921 | Herrman | 292/341.15 |
| 2,113,121 | 4/1938 | Peterson | 292/341.15 |
| 2,246,344 | 6/1941 | Calderwood | 292/341.15 |
| 3,204,996 | 9/1965 | Behrens | 292/341.15 |
| 3,806,176 | 4/1974 | Massie | 292/341.15 X |
| 4,482,177 | 11/1984 | Nagy | 292/341.15 X |

*Primary Examiner*—Gary L. Smith
*Assistant Examiner*—Michael Milano
*Attorney, Agent, or Firm*—Joseph H. Roediger

[57] ABSTRACT

A safety device for screen and storm secondary doors in which a movable rod is horizontally mounted on the door jamb proximate to the latch receiving mechanism. The closure of the inner or primary door urges the rod into position so as to disable the latching mechanism of the screen door. The opening of the primary door enables the rod to be withdrawn thereby permitting the secondary door to be opened.

6 Claims, 1 Drawing Sheet

SAFETY DEVICE FOR DISABLING A SCREEN DOOR LATCHING MECHANISM

BACKGROUND OF THE INVENTION

This invention relates to a safety device for disabling the latching mechanism of a screen or storm door either upon closure of the primary door or by manual operation when the primary door is open.

While the primary door in a residence is normally a solid-core door outfitted with at least one sturdy lock mechanism, the outer or secondary door which is typically a storm or screen door is unlikely to be provided with a substantial locking mechanism. In practice, the secondary door is provided with a latching mechanism that engages a moveable latch bar mounted on the door jamb between the secondary and primary doors. Since the secondary door frequently contains removable glass panels or readily-slit screening, it is not terribly difficult for one desiring to open the secondary door to gain access to the latching mechanism, if it happens to be locked. Normally, entry into the residence is barred by the primary door and its locking mechanism. While it is well publicized that the primary door defines the line of defense for a residence against unwanted intruders, the homeowner frequently responds to a knock or a doorbell ring by first opening the primary door to view the individual standing out front through the secondary door.

When the primary door has been opened, prior action by the potential intrude can result in his having gained access to the locking mechanism of the secondary door with the result that the occupant is facing the potential intruder without a protective barrier therebetween. As a consequence, the individual desiring to commit a crime has immediate and direct access to the house with the occupant being deprived of any protective element to be overcome and which serves to provide time to close the primary door or to summon assistance. Although several secondary door latching mechanisms have disabling means built into them, the typical manner of disabling a screen door latching mechanism is by a toggle lock located on the handle of the latch. This toggle is immediately accessible to one who has either pierced the screen door or previously removed a glass panel from a storm door. In order for the occupant to attempt to prevent the unlatching of the mechanism, he is obliged to place his hand in close proximity to that of the intruder in order to resist movement of the toggle. However, even this opportunity to interpose a barrier between a potential felon and the occupant may not be available since people typically hold their secondary door open while unlocking the primary door to enter the residence with the result that the secondary door closes under its own power. Frequently, the occupant locks the primary door without remembering the need to secure the secondary door by a separate action.

Accordingly, the present invention is directed to a safety device which disables the latching mechanism of a secondary door as soon as the primary door has been closed. In addition, the safety device of the present invention can be utilized to disable the door latching mechanism even when the primary door remains open. Furthermore, the present invention can be readily installed on the door jamb without requiring removal or adjustment of the secondary door or its latch receiving mechanism. The ease of manufacture and relatively low cost of doing same are important aspects of the invention as well.

SUMMARY OF THE INVENTION

The present invention is directed to a safety device for use in combination with the door latching mechanism for a secondary door of the type herein a latch receiving bar is movably mounted on the surface of the door jamb inwardly of the secondary door. The moveable latch bar normally is vertically disposed on the jamb to engage the latch of the secondary door after being depressed by the latch as the door moves to the fully closed position. The moveable latch bar is typically a vertical bar contained in opposing horizontal guides and biased outwardly from the jamb in a normally open or extended position When the secondary door is closed, the latch depresses the latch bar by overcoming the bias force and moves therepast. When the latch bar is restored to its initial position, it serves to resist direct movement of the latch in an outward direction and the secondary door then cannot be opened by merely pulling the exterior handle.

The improvement of the present invention comprises a guide means which is mounted to the door jamb proximate to and inwardly of the latch bar which receives and retains the latch of the secondary door. This guide means movably supports a barrier member therein. The barrier member is provided with first and second ends and is movably mounted and aligned in the guide means so as to permit the first end to extend beneath the latch bar when it is in its outward-biased position spaced from the jamb. Thus, the barrier member can be moved to a position wherein its first end is positioned between the latch bar and the jamb. This serves to limit movement of the secondary door resulting from its latch mechanism being actuated by either the exterior or interior handles. The second end of the barrier member extends inwardly away from the latch bar and thus is in contact with or in close proximity to the surface of the primary door when it is in its closed position. As a result, the barrier member is urged beneath the latch bar by the primary door each time the primary door is closed.

When the occupant leaves his place of residence, the barrier member is withdrawn from the guide means and the primary and secondary doors are closed and locked using the conventional procedure. Upon return, the occupant opens the secondary door, unlocks and opens the primary door and enters the residence. The secondary door normally is urged closed by its associated mechanism, either hydraulic or spring actuated, and the barrier is replaced in the guide means. When the occupant then closes the primary door, the second end of the barrier member is contacted by the primary door and driven in the direction of the secondary door. This places the first end of the barrier member again beneath the latch bar. As a result, the opening of the primary door from the interior finds the latching mechanism of the secondary the door disabled. Thus, the occupant is no longer in a situation where he finds the secondary door to be unlocked when the primary door is opened from inside the residence.

Further features and advantages will become more readily apparent from the following detailed description of the preferred embodiment when taken in conjunction with the accompanying drawings.

DESCRIPTION OF THE PREFERRED EMBODIMENT

Figure 1:
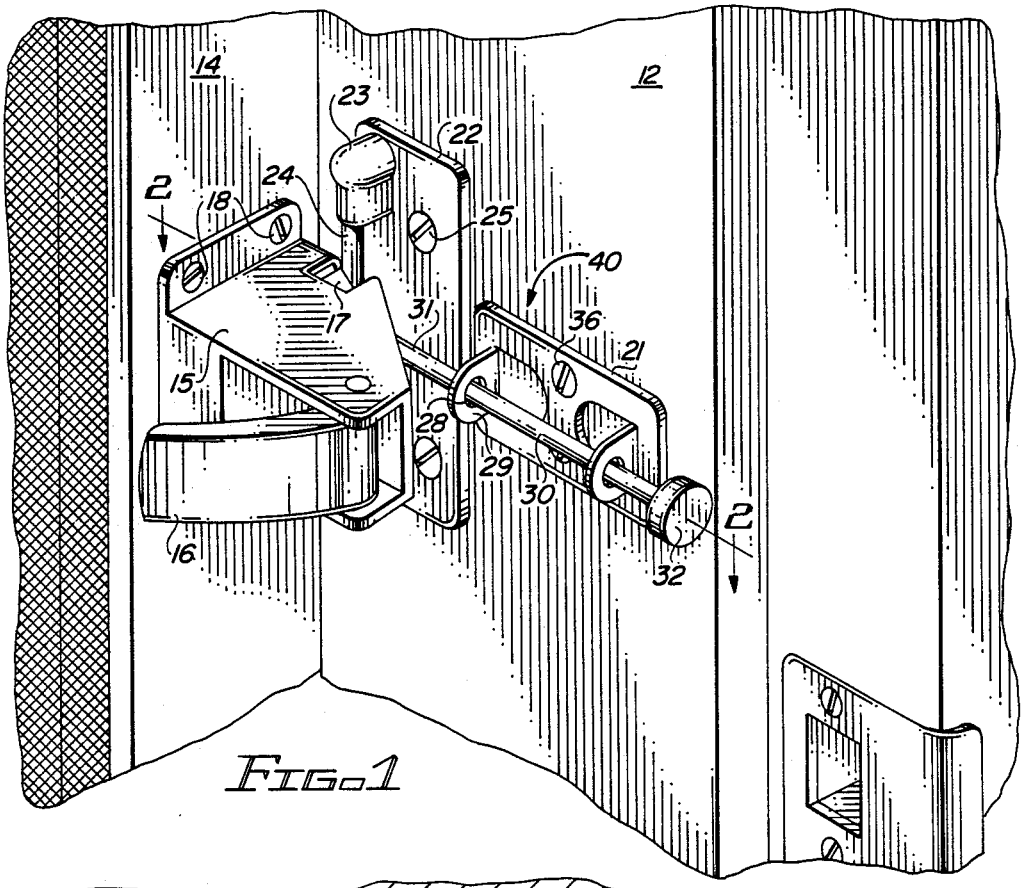
FIG. 1 is a perspective view of one embodiment of the invention with the secondary door closed and the primary door opened.

Referring now to FIG. 1, the present invention is shown in connection with a latching mechanism 15 mounted on a secondary screen door 14. A preferred embodiment of the invention 40 is shown affixed to the jamb 12 in the region between primary and secondary doors is positioned to disable the latch receiving mechanism adjacently spaced thereto. As shown, the safety device of the present invention is in position to prevent the secondary door from being opened without adjusting the position of the barrier 30 of the safety device.

The typical secondary door 14 is provided with a latching mechanism 15 on the inner surface thereof. As shown, the latching mechanism is attached to the door by threaded fasteners 18. A moveable latch bar 24 supported by bar guides 23 affixed to a latch bar plate is provided on the adjacent portion on the door jamb 12. After installation of the door and the affixation of its hinges, the installer marks the location of the latching mechanism and, in particular the latch 18 and associated override 17, so that the latch bar plate 22 can be affixed to the jamb by threaded fasteners 25 in proper position. In normal operation, movement of the interior handle 16 or the cooperating exterior handle (not shown) causes a movable override member 17 to depress the latch bar and move it out of the way so the fixed latch 18 can move therepast. Although not shown in the embodiment of FIG. 1, a toggle lock can be provided to permit the user to immobilize the override. This type of toggle is normally located on the undersurface of the interior handle 16 or on the top surface of the latching mechanism 15. Since the present invention is directed to a safety device for immobilizing the latch receiving bar, the particular constructional features of the latching mechanism 15 are not particularly pertinent to the description thereof.

Figure 2:
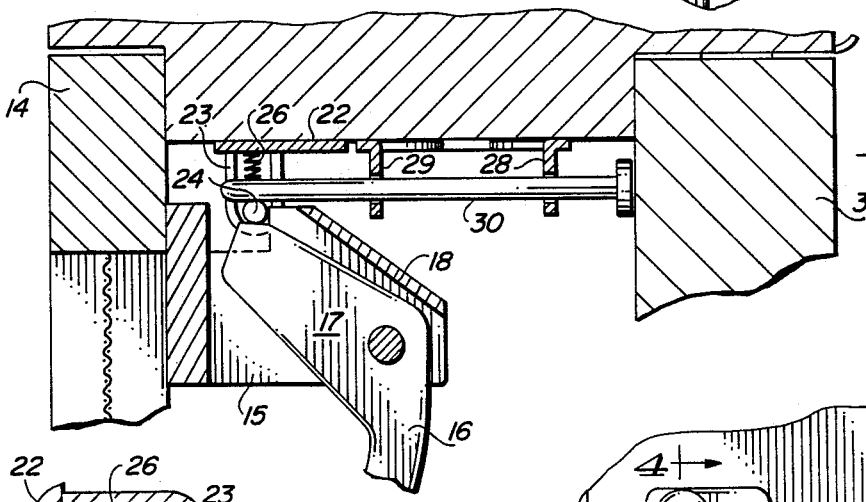
FIG. 2 is a view in section taken along line 2—2 of FIG. 1 the primary door closed.

The closure of the secondary door 14 against the corresponding surface of jamb 12 causes the fixed latch 18, shown more clearly in FIG. 2, to contact and depress the movable latch bar 24. The travel of the latch 18 past the latch bar 24 in its normal fully extended position determines the quality of the fit between secondary door and the jamb. When the door is closed as shown in FIG. 2, the edge of latch 18 is either in direct contact with the extended latch bar or fairly close thereto. The interior handle 16 of the latching mechanism is directly connected to the override 17 thereby permitting the latch bar to be urged from its fully extended position so as to enable the latch 18 to move therepast and the secondary door to be opened. The override 17 is directly connected to an exterior handle for the latching mechanism.

As shown in FIG. 2, the latch bar ends are contained in adjacently spaced bar guides 23 which contain biasing springs 26 tending to force the latch bar to its extended position The bar guides 23 are either attached to a large area latch bar plate 22 or formed integral therewith. The latch bar plate is flush mounted on the surface of the jamb 12 as shown in FIGS. 1 and 2. As mentioned previously, the latching mechanism 15 may itself be provided with locking means for inhibiting movement of the latching mechanism handles and thus tending to keep the secondary door closed until the lock is manually moved to another position. In addition, the secondary door may be provided with automatic closure means either hydraulic or a closure spring if desired.

Figure 4:
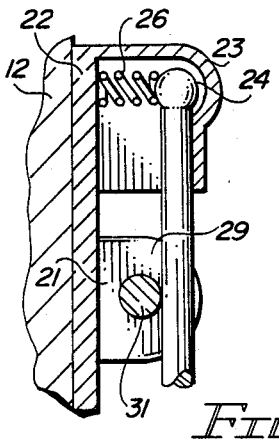
FIG. 4 is a view in section taken along line 4—4 of FIG. 3.

When the secondary door is in the closed position shown in FIGS. 1 and 2, the subject invention permits the occupant of the dwelling to disable the latch bar by the use of a movable barrier 30 slideably contained in openings 28 of spaced flanges 29. The flanges are shown in FIG. 1 as being stamped from the guide means backing plate 21 which is mounted by threaded fasteners 36 to the jamb 12. The barrier member 30 is provided with first end 31 that permits removal of the barrier from the flange openings 28 when leaving the residence. Also, the diameter of the barrier first end is dimensioned fit between the latch bar plate 22 and the latch bar 24 when it is in its fully extended position as shown in FIG. 4. The second end 32 of barrier 30 is provided with an enlarged head to permit it to be readily grasped by the user and also to reduce marring of the primary door 34 for reasons that will later be discussed.

When the occupant of the residence has entered his dwelling, and before the primary door 14 has been fully closed, the occupant inserts the barrier 30 in the flange openings and urges it forward in the position shown in FIG. 2. Consequently, the latch bar 24 cannot be moved inwardly by override 17 and the door is secure. If the occupant should desire to leave his residence, the primary door is opened and the barrier 30 removed to permit the pressure on the interior handle 16 to depress latch bar 24 and permit the secondary door 14 to be opened. Next, the occupant closes the primary door 34 and locks it 1 permitting the secondary door to close in a normal fashion. However, during the time that the occupant is at home and the barrier located in the device, the barrier is in position to prevent depression of the latch bar 24 since the length of the barrier is selected to be somewhat greater than the distance between the latch bar and the outer surface of the primary door 34. This is noted more particularly in FIG. 3 wherein the relationship between the length of barrier 30 and the spacing between primary door and latch bar 24 is clearly shown. As a result, the failure of the occupant to fully place the first end 31 of the barrier element 30 under the latch bar 24 is automatically overcome by the contact between large area second end 32 and the surface of the primary door. The large area second end prevents the barrier 30 from being driven through the flange openings 28 so as to insure that a rapid closure of the primary door will not interfere with the disabling function of the present invention.

In FIG. 4, the cross sectional view taken through the bar guide 23 and the associated spring 26 show the application of the biasing force tending to urge latch bar 24 to its normal extended position. The diameter of the first end 31 of the barrier member is formed to be less than the spacing between the latch bar in its fully extended position and the surface of latch bar plate 22. As a result, the first end is well suited to move therebetween when driven forward by the primary door. While a particular type of guide and biasing spring are shown in FIG. 4, it should be noted that other constructions of movable latch bars may be employed if desired.

Figure 3:
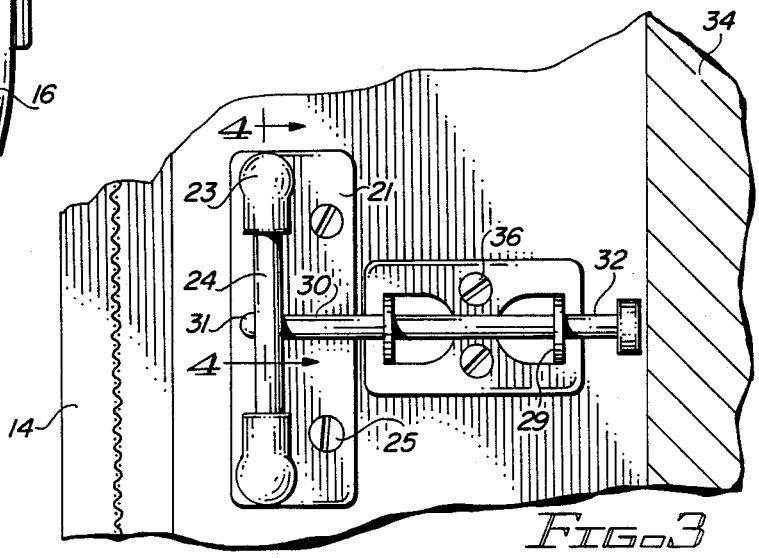
FIG. 3 is a side view of the invention showing the primary door closed.

The installation of the present invention can be readily accomplished by the homeowner. The placement of the backing plate 21 on the door jamb can be varied since the spaced flanges 29 provide the necessary support and guidance for the movement of the barrier and it is the length of the barrier between first and second ends as well as the diameter thereof which determine its effective operation in disabling the latch bar. While the embodiments of FIGS. 2 and 3 show the length of the barrier being greater than the distance between the primary door surface and the latch bar to ensure the automatic placement feature when the primary door is shown, it is to be noted that a shorter barrier element can be used if the user intends only manual operation. However, this alternate embodiment lacks a significant advantage of the present invention.

The embodiment shown is relatively inexpensive to manufacture since the guide means backing plate 21 can be formed of a single metal blank which has the holes for fasteners 36 and the openings 28 formed therein. The flanges then can be stamped from the guide means backing plate in a succeeding operation. The barrier can be formed with a uniformally small diameter central body with the enlarged head being pressure formed thereon. A separate large diameter end can be affixed by welding. The installation of the device as previously noted is simple and straight forward and can be accomplished by the homeowner without critical measurements being made or elaborate tools required. While the above description has referred to a preferred embodiment of the invention, it is noted that many modifications and variations may be made therein without departing from the scope of the invention as claimed.

What I claim is:

1. In a door latching mechanism of the type wherein mechanism having a movable vertical latch bar mounted on the surface of a door jamb between inner and outer doors for engagement with latching means located on the outer door, said latch bar having an extended position for engagement wherein said latch bar is spaced by a first distance from said jamb, the improvement which comprises:

(a) guide means for movably receiving a barrier member therein;

(b) means for mounting said guide means to said jamb proximate to said latch bar; and (c) an elongate barrier member having first and second ends, said barrier member having a length greater than the distance between the inner door and the latch bar, said barrier member being movably mounted and aligned in said guide means, said second end being contacted by ther inner door upon closure to urge said first end beneath said latch bar when in said extended position, the movement of the barrier member beneath said latch bar limiting movement thereof and preventing the opening of the outer door.

2. The invention in accordance with claim 1 wherein said guide means is mounted to maintain said barrier member in a substantially horizontal position.

3. The invention in accordance with claim 2 wherein said barrier member is an elongated cylinder, the first end of said cylinder being dimensioned to fit beneath said latch bar.

4. The invention in accordance with claim 3 wherein said guide means includes at least two laterally spaced supports for receiving the barrier member.

5. The invention in accordance with claim 4 wherein said guide means includes a base plate and said supports each comprise an apertured flange extending outwardly therefrom.

6. The invention in accordance with claim 5 wherein said barrier member includes stop means on the second end thereof.

* * * * *

UNITED STATES PATENT AND TRADEMARK OFFICE

CERTIFICATE OF CORRECTION

PATENT NO. : 4,902,054

DATED : 2/20/90

INVENTOR(S) : David A. Swanson

It is certified that error appears in the above-identified patent and that said Letters Patent are hereby corrected as shown below:

Column 5 and 6:

Claim 1 preamble should read:

In combination with an outer door latching mechanism having a movable vertical latch bar mounted on the surface of a door jamb between inner and outer doors for engagement with latching means located on the outer door, said latch bar having an extended position for engagement wherein said latch bar is spaced by a first distance from said jamb, the improvement which comprises:

Claim 1(b) should read:

means for mounting said guide means to said jamb between the inner door and said latch bar; and

Signed and Sealed this

Twenty-seventh Day of November, 1990

*Attest:*

HARRY F. MANBECK, JR.

*Attesting Officer*

*Commissioner of Patents and Trademarks*